US011069285B2

(12) United States Patent
Song

(10) Patent No.: US 11,069,285 B2
(45) Date of Patent: Jul. 20, 2021

(54) LUMINANCE COMPENSATION METHOD AND APPARATUS, AND DISPLAY DEVICE

(71) Applicant: BOE TECHNOLOGY GROUP CO., LTD., Beijing (CN)

(72) Inventor: Danna Song, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/643,317

(22) PCT Filed: Jul. 17, 2019

(86) PCT No.: PCT/CN2019/096356
§ 371 (c)(1),
(2) Date: Feb. 28, 2020

(87) PCT Pub. No.: WO2020/020033
PCT Pub. Date: Jan. 30, 2020

(65) Prior Publication Data

US 2020/0410929 A1 Dec. 31, 2020

(30) Foreign Application Priority Data

Jul. 25, 2018 (CN) ..... 201810829318.9

(51) Int. Cl.
*G09G 3/3208* (2016.01)
*G09G 3/3225* (2016.01)

(52) U.S. Cl.
CPC ... *G09G 3/3208* (2013.01); *G09G 2320/0233* (2013.01); *G09G 2360/14* (2013.01); *G09G 2360/16* (2013.01)

(58) Field of Classification Search
CPC ..... G09G 2360/14; G09G 2360/16; G09G 2320/0233; G09G 2320/043
See application file for complete search history.

(56) References Cited

U.S. PATENT DOCUMENTS 7,227,519 B1 6/2007 Kawase et al.
9,214,107 B2 * 12/2015 Fish ..... G09G 3/3233
(Continued)

FOREIGN PATENT DOCUMENTS

CN 1377495 A 10/2002
CN 101477783 A 7/2009
(Continued)

OTHER PUBLICATIONS

Lei Zhang et al., "AMOLED gray level compensation algorithm," Electronic Measurement Technology, China Academic Journal Electronic Publishing House, Sep. 2015, pp. 35-39, with English language translation.
(Continued)

*Primary Examiner* — Sepehr Azari
(74) *Attorney, Agent, or Firm* — McDermott Will and Emery LLP

(57) ABSTRACT

A luminance compensation method is configured to compensate luminance of a plurality of sub-pixels included in a display device. The luminance compensation method includes a curve generation and update process and a compensation process for each sub-pixel to be compensated. The curve generation and update process includes: detecting an actual luminance value of the sub-pixel to be compensated in real time; and generating an actual luminance curve showing how the actual luminance value of the sub-pixel to be compensated changes as a gray-scale value changes according to actual luminance values detected in real-time, and updating the actual luminance curve. The compensation process includes: obtaining an ideal luminance value corresponding to a gray-scale value to be input to the sub-pixel to be compensated, the ideal luminance value being a luminance value of the sub-pixel to be compensated after the gray-scale value is input to the sub-pixel to be compensated
(Continued)

in a case where a light-emitting device in the sub-pixel to be compensated is not aged; and calculating a gray-scale value corresponding to an actual luminance value that is equal to the obtained ideal luminance value according to the actual luminance curve of the sub-pixel to be compensated, the gray-scale value being used as a gray-scale value that will actually be input to the sub-pixel to be compensated.

16 Claims, 6 Drawing Sheets

(56) References Cited

U.S. PATENT DOCUMENTS

2005/0104821 A1* 5/2005 Doe ..... G09G 3/3216 345/82
2005/0253786 A1 11/2005 Lee
2008/0180375 A1* 7/2008 Wang ..... G09G 3/3611 345/89
2009/0033688 A1* 2/2009 Lin ..... G09G 3/3413 345/691
2009/0174628 A1* 7/2009 Wang ..... G09G 3/3225 345/76
2013/0135272 A1* 5/2013 Park ..... G09G 3/3233 345/211
2013/0194199 A1* 8/2013 Lynch ..... G06F 3/0421 345/173
2014/0063080 A1* 3/2014 Wu ..... G09G 3/3225 345/690
2016/0042676 A1* 2/2016 Berkeley ..... G09G 3/006 345/589
2016/0267838 A1 9/2016 Zhang et al.
2017/0243562 A1 8/2017 Hu et al.
2017/0249890 A1* 8/2017 Yoo ..... G09G 3/2074
2018/0040295 A1* 2/2018 Deng ..... G09G 5/10
2018/0336822 A1* 11/2018 Yan ..... G09G 3/3233
2019/0051236 A1* 2/2019 Deng ..... G09G 3/3225
2019/0057657 A1* 2/2019 Liu ..... G09G 3/3208
2019/0206365 A1* 7/2019 Yin ..... G09G 3/3406
2019/0304403 A1* 10/2019 Hyun ..... G09G 5/10
2019/0385544 A1* 12/2019 Tan ..... G09G 5/10

FOREIGN PATENT DOCUMENTS

CN 102855842 A 1/2013
CN 104021759 A 9/2014
CN 104992657 A 10/2015
CN 105469769 A 4/2016
CN 105529011 A 4/2016
CN 106782303 A 5/2017
CN 106887212 A 6/2017
CN 107785406 A 3/2018
CN 107958651 A 4/2018
CN 108877657 A 11/2018

OTHER PUBLICATIONS

Tixiang Gui, "Aspects of color display technology," Chinese Academic Journal Electronic Publishing House, Jun. 2013, pp. 80-86, with English language translation.
First Office Action issued in corresponding Chinese Application No. 201810829318.9, dated Dec. 4, 2019, with English language translation.

* cited by examiner

LUMINANCE COMPENSATION METHOD AND APPARATUS, AND DISPLAY DEVICE

CROSS-REFERENCE TO RELATED APPLICATIONS

This application is a national phase entry under 35 USC 371 of International Patent Application No. PCT/CN2019/096356 filed on Jul. 17, 2019, which claims priority to Chinese Patent Application No. 201810829318.9, filed with the Chinese Patent Office on Jul. 25, 2018, which are incorporated herein by reference in their entirety.

TECHNICAL FIELD

The present disclosure relates to the field of display technologies, and in particular, to a luminance compensation method and apparatus, and a display device.

BACKGROUND

An organic light-emitting diode (OLED) display device has advantages of self-luminescence, high contrast, high color gamut, wide viewing angle, light weight, small thickness, and flexibility.

In order to ensure a good display effect of the OLED display device, luminance of sub-pixels in the OLED display device needs to be compensated.

SUMMARY

In one aspect, a luminance compensation method is provided. The luminance compensation method is configured to compensate luminance of a plurality of sub-pixels included in a display device. The luminance compensation method includes a curve generation and update process and a compensation process for each sub-pixel to be compensated. The curve generation and update process includes: detecting an actual luminance value of the sub-pixel to be compensated in real time; generating an actual luminance curve showing how the actual luminance value of the sub-pixel to be compensated changes as a gray-scale value changes according to actual luminance values detected in real time; and updating the actual luminance curve. The compensation process includes: obtaining an ideal luminance value corresponding to a gray-scale value to be input to the sub-pixel to be compensated, the ideal luminance value being a luminance value of the sub-pixel after the gray-scale value is input to the sub-pixel to be compensated in a case where a light-emitting device in the sub-pixel to be compensated is not aged; and calculating a gray-scale value corresponding to an actual luminance value that is equal to the obtained ideal luminance value according to the actual luminance curve of the sub-pixel to be compensated, and using the gray-scale value as a gray-scale value that will actually be input to the sub-pixel to be compensated.

In some embodiments, updating the actual luminance curve, includes: updating the actual luminance curve according to at least one the actual luminance value detected in real time.

In some embodiments, generating an actual luminance curve showing how the actual luminance value of the sub-pixel to be compensated changes as a gray-scale value changes according to actual luminance values detected in real time includes: setting at least two marked gray-scale values; converting an actual luminance value detected in real time to a corresponding gray-scale value; determining whether the corresponding gray-scale value converted from the actual luminance value detected in real time is one marked gray-scale value of the at least two marked gray-scale values; if the corresponding gray-scale value converted from the actual luminance value detected in real time is one marked gray-scale value of the at least two marked gray-scale values, recording the actual luminance value corresponding to the marked gray-scale value and proceeding to a next step; if the corresponding gray-scale value converted from the actual luminance value detected in real time is not one marked gray-scale value of the at least two marked gray-scale values, returning to the step of converting an actual luminance value detected in real time to a corresponding gray-scale value; and determining whether corresponding actual luminance values have been recorded for the at least two marked gray-scale values; if actual luminance values have been recorded for all the marked gray-scale values, performing a curve fitting according to all the marked gray-scale values and respective corresponding actual luminance values, so as to generate the actual luminance curve; if actual luminance values have not been recorded for the at least two marked gray-scale values, returning to the step of converting an actual luminance value detected in real time to a corresponding gray-scale value.

In some embodiments, updating the actual luminance curve according to the actual luminance values detected in real time includes: determining whether a gray-scale value converted from an actual luminance value detected at a current moment is one marked gray-scale value of the at least two marked gray-scale values; if the gray-scale value converted from the actual luminance value detected at a current moment is one marked gray-scale value of the at least two marked gray-scale values, updating an actual luminance value corresponding to the marked gray-scale value on the actual luminance curve to an actual luminance value detected at a current moment and proceeding to a next step; if the gray-scale value converted from the actual luminance value detected at a current moment is not one marked gray-scale value of the at least two marked gray-scale values, returning to the step of converting an actual luminance value detected in real time to a corresponding gray-scale value; and performing a curve refitting according to the marked gray-scale value and a corresponding updated actual luminance value, and at least one other marked gray-scale value and its corresponding actual luminance value, so as to obtain an updated actual luminance curve; and returning to the step of converting an actual luminance value detected in real time to a corresponding gray-scale value.

In some embodiments, updating the actual luminance curve according to the actual luminance values detected in real time includes: determining whether a gray-scale value converted from an actual luminance value detected at a current moment is one marked gray-scale value of the at least two marked gray-scale values; if the gray-scale value converted from the actual luminance value detected at a current moment is one marked gray-scale value of the at least two marked gray-scale values, determining whether the actual luminance value detected at the current moment is equal to an actual luminance value corresponding to the marked gray-scale value on the actual luminance curve; if the actual luminance value detected at the current moment is not equal to the actual luminance value corresponding to the marked gray-scale value on the actual luminance curve, updating the actual luminance value corresponding to the marked gray-scale value on the actual luminance curve to the actual luminance value detected at the current moment and proceeding to a next step; if the actual luminance value detected at the current moment is equal to the actual luminance value corresponding to the marked gray-scale value on the actual luminance curve, returning to the step of converting an actual luminance value detected in real time to a corresponding gray-scale value; if the gray-scale value converted from the actual luminance value detected at the current moment is not one marked gray-scale value of the at least two marked gray-scale values, returning to the step of converting an actual luminance value detected in real time to a corresponding gray-scale value; and performing a curve refitting according to the marked gray-scale value and a corresponding updated actual luminance value, and at least one other marked gray-scale value and its corresponding actual luminance value, so as to obtain an updated actual luminance curve; and returning to the step of converting an actual luminance value detected in real time to a corresponding gray-scale value.

In some embodiments, performing a curve fitting includes: using all the at least two marked gray-scale values and respective corresponding actual luminance values as multiple points on an actual luminance curve to be fitted; using a linear function to perform a fitting to obtain a line segment between every two adjacent points; and generating the actual luminance curve according to all the obtained line segments.

In some embodiments, calculating a gray-scale value corresponding to an actual luminance value that is equal to the obtained ideal luminance value according to the actual luminance curve of the sub-pixel to be compensated, includes: determining a point corresponding to the obtained ideal luminance value on the actual luminance curve; determining an expression of a function of a portion where the point is located of the actual luminance curve; and calculating a gray-scale value corresponding to an actual luminance value that is equal to the ideal luminance value according to the determined expression of the function.

In some embodiments, a number of the marked gray-scale values is greater than or equal to 2, and less than or equal to a maximum number of gray-scale values displayable by the sub-pixel to be compensated.

In some embodiments, detecting an actual luminance value of the sub-pixel to be compensated in real time includes: obtaining luminance data sensed by a photosensitive member corresponding to the sub-pixel to be compensated at least twice in a time of a frame so as to obtain at least two sets of luminance data; determining a sensing time corresponding to each set of luminance data; estimating an estimated luminance value of the sub-pixel to be compensated at a current moment in a current frame according to a gray-scale value to be input to the sub-pixel to be compensated at the current moment; estimating an estimated sensing time required for the photosensitive member corresponding to the sub-pixel to be compensated to obtain luminance data corresponding to the estimated luminance value; and selecting a set of luminance data with a sensing time closest to the estimated sensing time from the at least two sets of luminance data, and determining an actual luminance value of the sub-pixel to be compensated in the current frame according to the set of luminance data.

In some embodiments, the luminance data is sensed 3 to 6 times in the time of a frame, so as to obtain 3 to 6 sets of luminance data.

In some embodiments, detecting an actual luminance value of the sub-pixel to be compensated in real time includes: estimating an estimated luminance value of the sub-pixel to be compensated at a current moment in a current frame according to a gray-scale value to be input to the sub-pixel to be compensated at the current moment in a current frame; estimating an estimated sensing time required for the photosensitive member corresponding to the sub-pixel to be compensated to obtain luminance data corresponding to the estimated luminance value; and obtaining luminance data sensed by the photosensitive member corresponding to the sub-pixel to be compensated at a moment after the estimated sensing time passes since a starting moment of the current frame, and determining an actual luminance value of the sub-pixel to be compensated in a current frame according to the luminance data.

In some embodiments, estimating an estimated luminance value of the sub-pixel to be compensated at a current moment in a current frame according to a gray-scale value to be input to the sub-pixel to be compensated at the current moment includes: determining whether an actual luminance curve has been generated for the sub-pixel to be compensated at the current moment; and if an actual luminance curve has been generated for the sub-pixel to be compensated at the current moment, obtaining an actual luminance value corresponding to the gray-scale value to be input to the sub-pixel to be compensated at the current moment according to the actual luminance curve at the current moment, the obtained actual luminance value being used as the estimated luminance value; and if an actual luminance curve has not been generated for the sub-pixel to be compensated at the current moment, obtaining an ideal luminance value corresponding to the gray-scale value to be input to the sub-pixel to be compensated at the current moment according to an ideal luminance curve, the obtained ideal luminance value being used as the estimated luminance value.

In some embodiments, obtaining an ideal luminance value corresponding to a gray-scale value to be input to the sub-pixel to be compensated includes: reading a pre-stored ideal luminance curve showing how the ideal luminance value of the sub-pixel to be compensated changes as the gray-scale value changes, and obtaining the ideal luminance value corresponding to the gray-scale value to be input to the sub-pixel to be compensated.

In some embodiments, the luminance compensation method further includes generating the ideal luminance curve, which includes: under a condition where the light-emitting device in the sub-pixel to be compensated is not aged, detecting ideal luminance values of the sub-pixel to be compensated at different gray-scales to obtain at least two sets of data indicating a correspondence between gray-scale values and ideal luminance values; and performing a curve fitting according to the at least two sets of data indicating the correspondence between the gray-scale values and the ideal luminance values, so as to obtain the ideal luminance curve.

In another aspect, a luminance compensation apparatus is provided. The luminance compensation apparatus includes: a plurality of photosensitive members that are in one-to-one correspondence with a plurality of sub-pixels of a display device, each photosensitive member being configured to sense luminance of a corresponding sub-pixel in real time and output luminance data; a processor connected to the plurality of photosensitive members, the processor being configured to receive luminance data output from each photosensitive member, determine an actual luminance value of the corresponding sub-pixel in real time, generate an actual luminance curve showing how the actual luminance value of each sub-pixel changes as a gray-scale value changes, and update the actual luminance curve; and a memory connected to the processor, the memory being configured to store a latest actual luminance curve of each sub-pixel and an ideal luminance curve of each sub-pixel showing how an ideal luminance value of each sub-pixel changes as the gray-scale value changes, the ideal luminance value being a luminance value of a corresponding sub-pixel in a case where a light-emitting device in the sub-pixel is not aged. The processor is further configured to: obtain an ideal luminance value corresponding to a gray-scale value to be input to the corresponding sub-pixel according to the ideal luminance curve of each sub-pixel, and calculate a gray-scale value corresponding to an actual luminance value that is equal to the obtained ideal luminance value according to the actual luminance curve of the corresponding sub-pixel, the gray-scale value being used as a gray-scale value that will actually be input to the corresponding sub-pixel.

In some embodiments, the processor is further configured to: obtain luminance data sensed by a photosensitive member corresponding to each sub-pixel at least twice in a time of a frame so as to obtain at least two sets of luminance data, select one set of luminance data from the at least two sets of luminance data, and determine an actual luminance value of the corresponding sub-pixel in a current frame according to the selected one set of luminance data.

In yet another aspect, a computer program product is provided. The computer program product includes instructions that, when run on a computer, cause the computer to execute one or more steps of the luminance compensation method described in any one of the above embodiments.

In yet another aspect, a non-transitory computer-readable storage medium is provided. The non-transitory computer-readable storage medium stores computer instructions that are configured to perform one or more steps of the luminance compensation method described in any one of the above embodiments.

In yet another aspect, a display device is provided. The display device includes the luminance compensation apparatus described in any one of the above embodiments.

In yet another aspect, a display substrate is provided. The display substrate includes a plurality of sub-pixels; a plurality of photosensitive members that are in one-to-one correspondence with the plurality of sub-pixels, each photosensitive member being configured to sense luminance of a corresponding sub-pixel in real time; a plurality of driving lines, each driving line being connected to an input terminal of at least one photosensitive member of the plurality of photosensitive members, and each driving line being configured to drive corresponding at least one photosensitive member to sense luminance; and a plurality of sensing lines, each sensing line being connected to an output terminal of at least one photosensitive member of the plurality of photosensitive members, and each sensing line being configured to collect luminance data sensed by corresponding at least one photosensitive member.

BRIEF DESCRIPTION OF THE DRAWINGS

In order to describe technical solutions in embodiments of the present disclosure more clearly, the accompanying drawings to be used in the description of embodiments will be introduced briefly. Obviously, the accompanying drawings to be described below are merely some embodiments of the present disclosure, and a person of ordinary skill in the art can obtain other drawings according to these drawings.

DETAILED DESCRIPTION

Some embodiments of the present disclosure will be described with reference to the accompanying drawings. Obviously, the described embodiments are merely some but not all of the embodiments of the present disclosure. All other embodiments made on the basis of the embodiments of the present disclosure by a person of ordinary skill in the art shall be included in the protection scope of the present disclosure.

In the related art, each sub-pixel in an OLED display device includes an OLED light-emitting device, and it is possible for the sub-pixel to achieve display of different gray-scales by changing a luminance of the OLED light-emitting device therein.

However, the OLED light-emitting device will age over time, which makes it difficult for the corresponding sub-pixel to reach an ideal luminance value corresponding to a gray-scale value input to the sub-pixel (the ideal luminance value is a luminance value of the sub-pixel after the gray-scale value is input to the sub-pixel in a case where the light-emitting device in the sub-pixel is not aged). Under the premise that a same gray-scale value is input to the sub-pixel, the higher a degree of aging of the OLED light-emitting device is, the lower an actual luminance thereof is.

Further, in the OLED display device, OLED light-emitting devices in different sub-pixels are aged to different degrees. As a result, actual luminance displayed by different sub-pixels is different after the same gray-scale value is input to the different sub-pixels. Consequently, a display uniformity of the OLED display device is reduced, and a display effect is affected.

Some embodiments of the present disclosure provide a luminance compensation method. The luminance compensation method is configured to compensate luminance of a plurality of sub-pixels included in a display device. In some examples, the display device is a self-luminous display device, such as an OLED display device. The display device includes a plurality of sub-pixels. Each sub-pixel includes a light-emitting device, and each sub-pixel is correspondingly provided with at least one photosensitive member for sensing luminance of the sub-pixel. The photosensitive member is, for example, an optical sensor such as a photosensitive diode. In this way, it may be possible to use the photosensitive member to sense luminance of a corresponding sub-pixel (a light-emitting device of the sub-pixel) in real time. The sensed real-time luminance data may be used as a basis for calculating a compensation value to compensate the luminance of the sub-pixel in the luminance compensation method provided in some embodiments of the present disclosure.

Figure 1:
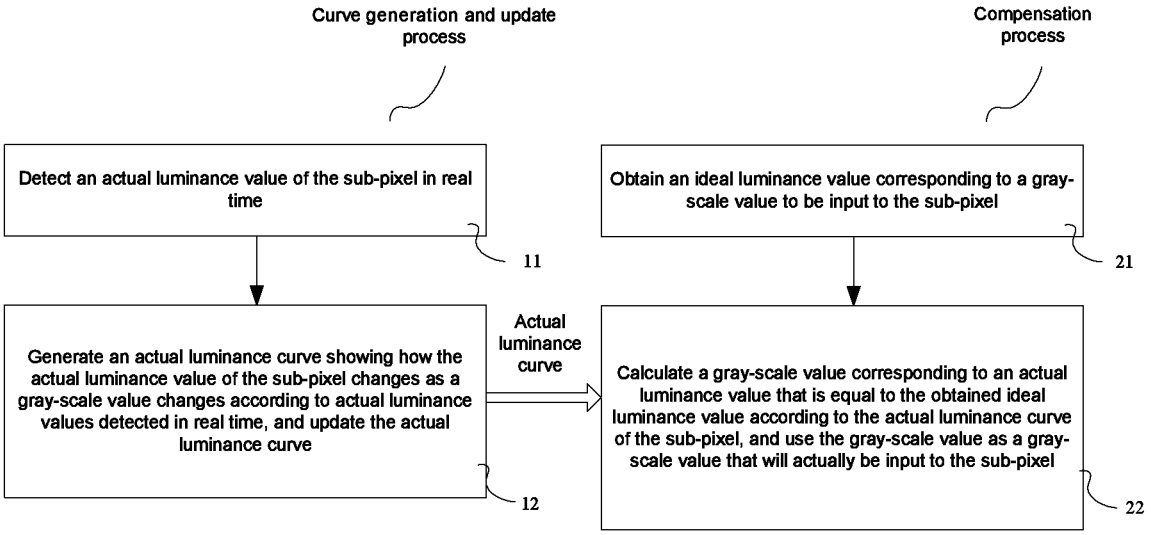
FIG. 1 is a schematic flow diagram of a luminance compensation method, according to some embodiments of the present disclosure.

The luminance compensation method provided in some embodiments of the present disclosure will be described below. As shown in FIG. 1, the luminance compensation method includes two processes, i.e., a curve generation and update process and a compensation process, for each sub-pixel to be compensated.

The curve generation and update process includes step 11 and step 12.

In step 11, an actual luminance value of the sub-pixel is detected in real time.

Figure 2:
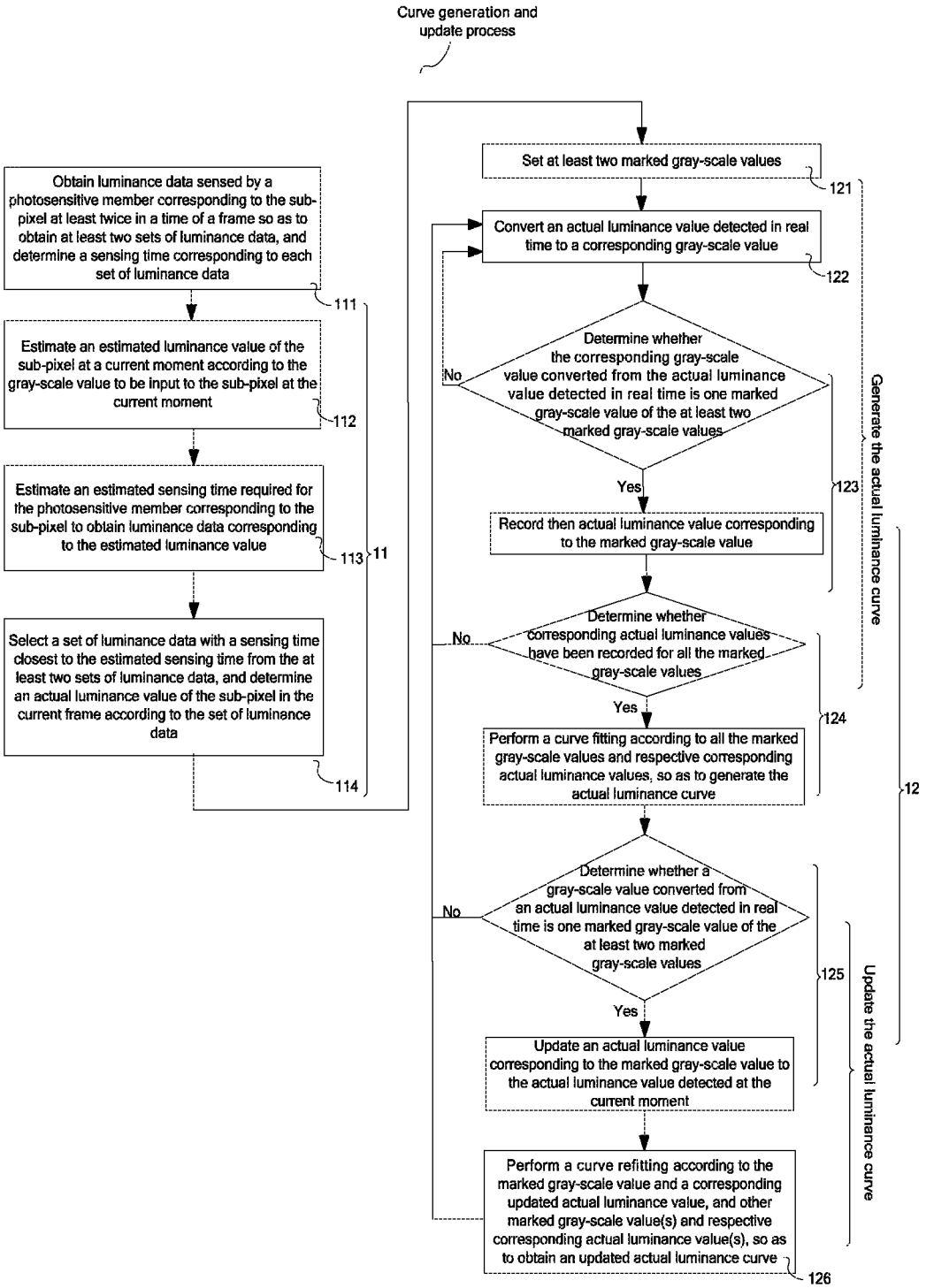
FIG. 2 is a schematic flow diagram of a curve generation and update process in a luminance compensation method, according to some embodiments of the present disclosure.

There are various ways to detect the actual luminance value of the sub-pixel in real time. In some embodiments, as shown in FIG. 2, step 11 includes the following step 111 to step 114.

In step 111, luminance data sensed by a photosensitive member corresponding to the sub-pixel is obtained at least twice in a time of a frame so as to obtain at least two sets of luminance data, and a sensing time corresponding to each set of luminance data is determined.

For example, a photosensitive member corresponding to each sub-pixel is used to sense the luminance of the sub-pixel in real time, and the luminance data generated by the photosensitive member sensing the luminance is real-time and may be constantly changing.

The photosensitive member requires different sensing times for sensing luminance in different ranges. The lower the luminance is, the longer the sensing time is. The higher the luminance is, the shorter the sensing time is. Therefore, based on this characteristic of the photosensitive member, photosensitive data may be obtained at different time points in the time of a frame, so as to obtain luminance data sensed by the photosensitive member in different sensing times.

Figure 3:
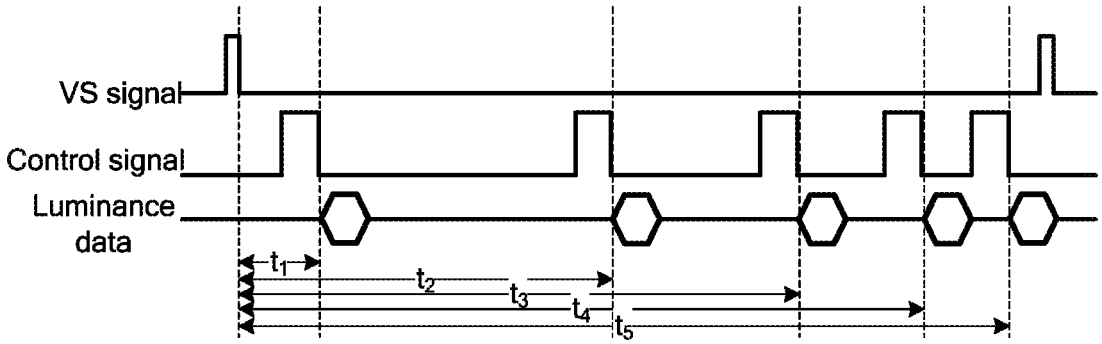
FIG. 3 is a schematic timing diagram of obtaining luminance data in a luminance compensation method, according to some embodiments of the present disclosure.

For example, the luminance data is sensed 3 to 6 times in the time of a frame, so as to obtain 3 to 6 sets of luminance data. FIG. 3 is a timing diagram of obtaining the luminance data multiple times in the time of a frame. In FIG. 3, a VS (Vertical Sync) signal is a frame synchronization signal, and a time between two VS signal pulses is the time of a frame. The control signal is a synchronization signal for obtaining the luminance data, and one control signal pulse indicates that the luminance data is obtained once. The luminance data is data transmitted from the photosensitive member to a processor in a driver integrated circuit (IC) in the display device. In FIG. 3, the optical sensor transmits five sets of luminance data to the processor in the time of a frame, and the five sets of luminance data correspond to sensing times $t_1$, $t_2$, $t_3$, $t_4$, and $t_5$.

In step 112, an estimated luminance value of the sub-pixel at a current moment is estimated according to the gray-scale value to be input to the sub-pixel at the current moment.

In this step, the gray-scale value to be input to the sub-pixel at the current moment may be obtained from a timing controller in the driver IC of the display device, and the luminance value of the sub-pixel at the current moment (i.e., the estimated luminance value) may be estimated according to the obtained gray-scale value.

Figure 4:
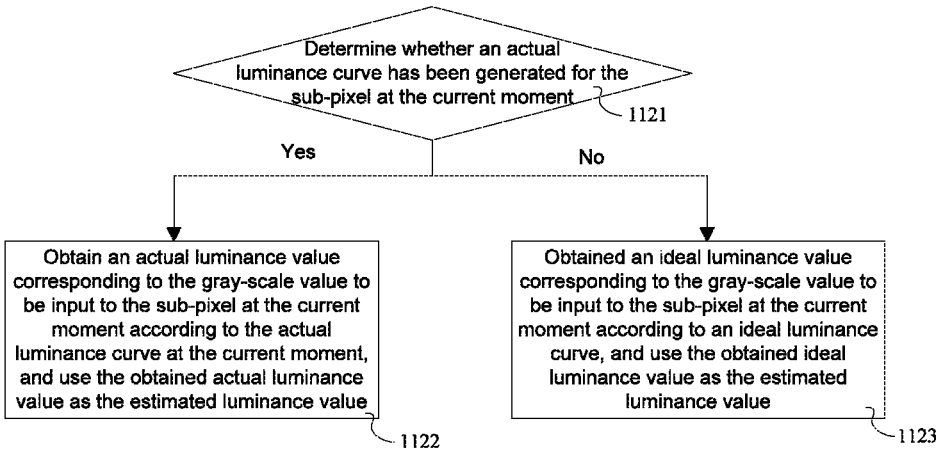
FIG. 4 is a schematic flow diagram of obtaining an estimated luminance value in a luminance compensation method, according to some embodiments of the present disclosure.

In some examples, as shown in FIG. 4, step 112 includes step 1121 to step 1123.

In step 1121, it is determined whether an actual luminance curve has been generated for the sub-pixel at the current moment. If an actual luminance curve has been generated for the sub-pixel at the current moment, step 1122 is performed; if an actual luminance curve has not been generated for the sub-pixel at the current moment, step 1123 is performed.

In step 1122, an actual luminance value corresponding to the gray-scale value to be input to the sub-pixel at the current moment is obtained according to the actual luminance curve at the current moment, and the obtained actual luminance value is used as the estimated luminance value.

In step 1123, an ideal luminance value corresponding to the gray-scale value to be input to the sub-pixel at the current moment (that is, a luminance value of the sub-pixel after the gray-scale value is input to the sub-pixel in a case where the light-emitting device in the sub-pixel is not aged) is obtained according to an ideal luminance curve, and the obtained ideal luminance value is used as the estimated luminance value.

In step 113, an estimated sensing time required for the photosensitive member corresponding to the sub-pixel to obtain luminance data corresponding to the estimated luminance value is estimated.

In this step, according to the principle that the photosensitive member requires different sensing times for sensing luminance in different ranges, it may be possible to estimate the estimated sensing time required for the photosensitive member corresponding to the sub-pixel to obtain the luminance data corresponding to the estimated luminance value. For example, the estimated sensing time is to.

In step 114, a set of luminance data with a sensing time closest to the estimated sensing time is selected from the at least two sets of luminance data, and an actual luminance value of the sub-pixel in the current frame is determined according to the set of luminance data.

In this step, with continued reference to FIG. 3, if it is assumed that the obtained five sets of luminance data correspond to sensing times of $t_1$, $t_2$, $t_3$, $t_4$, and $t_5$, and $t_2$ is closest to $t_0$ determined in step 113, then it means that the luminance data obtained when the sensing time is $t_2$ is closest to the actual luminance value of the luminance of the sub-pixel in the current frame. That is to say, among the five sets of luminance data, the luminance data obtained when the sensing time is $t_2$ is most accurate.

It will be noted that, in at least two sensing times corresponding to the obtained at least two sets of luminance data, in a case where at least two sensing times are both closest to the estimated sensing time, any one of the at least two sensing times is selected to determine the luminance data, which will be used as the actual luminance value closest to the luminance of the sub-pixel in the current frame.

By performing the above step 111 to step 114, it may be possible to obtain real-time sensing data of the photosensitive member multiple times at different time points in the time of a frame, so as to obtain multiple sets of luminance data. A single set of luminance data with a sensing time closest to the estimated sensing time is selected from the multiple sets of luminance data, and the actual luminance value of the sub-pixel in the current frame is determined according to the selected set of luminance data. Since the estimated sensing time to is a sensing time estimated according to the estimated luminance value of the sub-pixel at a gray-scale value in the current frame, an accuracy of the actual luminance value determined through the above steps is relatively high. Therefore, the accuracy of the detected actual luminance value of the sub-pixel may be improved, which is conducive to improving an accuracy and effectiveness of compensating the luminance of the sub-pixel.

Figure 5:
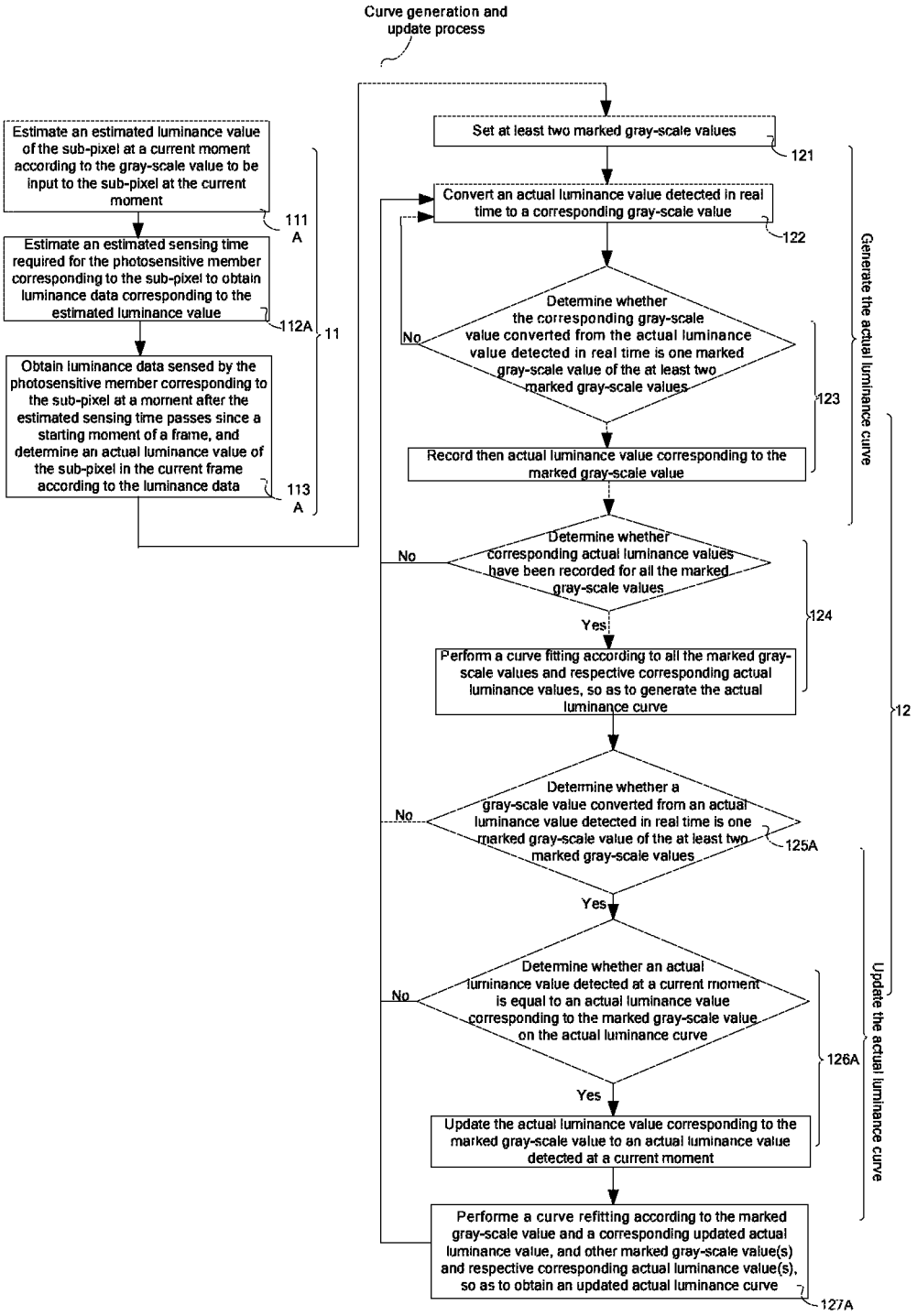
FIG. 5 is a schematic flow diagram of another curve generation and update process in a luminance compensation method, according to some embodiments of the present disclosure.

In some other embodiments, as shown in FIG. 5, step 11 includes step 111A to step 113A.

In step 111A, an estimated luminance value of the sub-pixel at a current moment is estimated according to the gray-scale value to be input to the sub-pixel at the current moment.

In this step, the gray-scale value to be input to the sub-pixel at the current moment may be obtained from the timing controller in the driver IC of the display device, and the luminance of the sub-pixel at the current moment (i.e., the estimated luminance value) may be estimated according to the obtained gray-scale value. In some examples, a method of estimating the estimated luminance value of the sub-pixel at the current moment in step 111A is the same as a method of estimating the estimated luminance value of the sub-pixel at the current moment in step 122.

In step 112A, an estimated sensing time required for the photosensitive member corresponding to the sub-pixel to obtain luminance data corresponding to the estimated luminance value is estimated.

In this step, according to the principle that the photosensitive member requires different sensing times for sensing luminance in different ranges, it may be possible to estimate the estimated sensing time required for the photosensitive member corresponding to the sub-pixel to obtain the luminance data corresponding to the estimated luminance value. For example, the estimated sensing time is to.

In step 113A, luminance data sensed by the photosensitive member corresponding to the sub-pixel is obtained at a moment after the estimated sensing time passes since a starting moment of a frame, and an actual luminance value of the sub-pixel in the current frame is determined according to the luminance data.

The photosensitive member requires different sensing times for sensing luminance in different ranges. Based on this characteristic of the photosensitive member, in the time of a frame, the set of luminance data sensed by the photosensitive member corresponding to the sub-pixel at a moment after the estimated sensing time passes since the starting moment of the frame is obtained, and the actual luminance value of the sub-pixel in the current frame is determined according to the set of luminance data. In this way, the luminance data sensed by the photosensitive member only needs to be obtained once in the time of a frame to determine the actual luminance value of the sub-pixel in the current frame, and the accuracy of the determined actual luminance value is also relatively high.

For example, as shown in FIG. 3, if the estimated sensing time to is equal to $t_2$, the set of luminance data sensed by the photosensitive member only needs to be obtained once at a moment when the sensing time reaches $t_2$, and then the actual luminance value of the sub-pixel in the current frame can be determined according to the set of luminance data.

By performing the above step 111A to step 113A, it may be possible to reduce the number of times of obtaining the luminance data sensed by the photosensitive member. Moreover, the accuracy of the detected actual luminance value of the sub-pixel is also relatively high, which is conducive to improving the accuracy and effectiveness of compensating the luminance of the sub-pixel.

In step 12, an actual luminance curve showing how the actual luminance value of the sub-pixel changes as a gray-scale value changes is generated according to actual luminance values detected in real time, and the actual luminance curve is updated.

As a possible implementation manner, with continued reference to FIG. 2, step S12 includes the following processes:

I—Curve generation period: the actual luminance curve is generated according to the actual luminance values detected in real time;

II—Curve update period: the actual luminance curve is updated on a basis of the generated actual luminance curve according to actual luminance values detected in real time.

In some embodiments, "I" is performed in an initial period of using the display device, and "II" is performed after the initial period. The initial period may be a time period after the display device is turned on for a first time, or "I" may be performed at a certain time in a predetermined time period of using the display device (for example, a time after the display device is turned on for several times, or a time after the display device is used for a certain period of time).

In some embodiments, as shown in FIG. 2, "I—Curve generation period" includes the following step 121 to step 124.

In step 121, at least two marked gray-scale values are set.

In this step, the number of the marked gray-scale values is greater than or equal to 2, and less than or equal to the maximum number of gray-scale values displayable by the sub-pixel. For example, if it is assumed that the maximum number of gray-scale values displayable by the sub-pixel is 256, then the number of the marked gray-scale values is greater than or equal to 2 and less than or equal to 256. For example, four marked gray-scale values (labeled as $G_1$, $G_2$, $G_3$, and $G_4$) are set in step 121.

In step 122, an actual luminance value detected in real time is converted to a corresponding gray-scale value.

In this step, for an actual luminance value of each frame detected in real time, a gray-scale value of the sub-pixel in the frame may be obtained from the driver IC of the display device. In this way, conversion of an actual luminance value to a corresponding gray-scale value may be achieved.

In step 123, it is determined whether the corresponding gray-scale value converted from the actual luminance value detected in real time is one marked gray-scale value of the at least two marked gray-scale values; if the corresponding gray-scale value converted from the actual luminance value detected in real time is one marked gray-scale value of the at least two marked gray-scale values, the actual luminance value corresponding to the marked gray-scale value is recorded, and step 124 is performed; and if the corresponding gray-scale value converted from the actual luminance value detected in real time is not one marked gray-scale value of the at least two marked gray-scale values, the method returns to step 122.

In step 124, it is determined whether corresponding actual luminance values have been recorded for all the marked gray-scale values; if corresponding actual luminance values have been recorded for all the marked gray-scale values, a curve fitting is performed according to all the marked gray-scale values and respective corresponding actual luminance values, so as to generate the actual luminance curve; and if corresponding actual luminance values have not been recorded for all the marked gray-scale values, the method returns to step 122.

By performing step 123 and step 124, it may be possible to obtain the actual luminance values corresponding to all the marked gray-scale values. Therefore, a number of points on the actual luminance curve to be generated showing how the actual luminance value changes as the gray-scale value changes may be obtained, and these points may be used to fit the actual luminance curve.

For example, it is assumed that there are four marked gray-scale values of $G_1$, $G_2$, $G_3$, and $G_4$; the marked gray-scale value $G_1$ correspond to an actual luminance value of $L_1$, the marked gray-scale value $G_2$ correspond to an actual luminance value of $L_2$, the marked gray-scale value $G_3$ correspond to an actual luminance value of $L_3$, and the marked gray-scale value $G_4$ correspond to an actual luminance value of $L_4$. Then, it can be seen that four points on the actual luminance curve to be generated are ($G_1$, $L_1$), ($G_2$, $L_2$), ($G_3$, $L_3$), and ($G_4$, $L_4$). The actual luminance curve may be obtained by fitting the four points.

Figure 6:
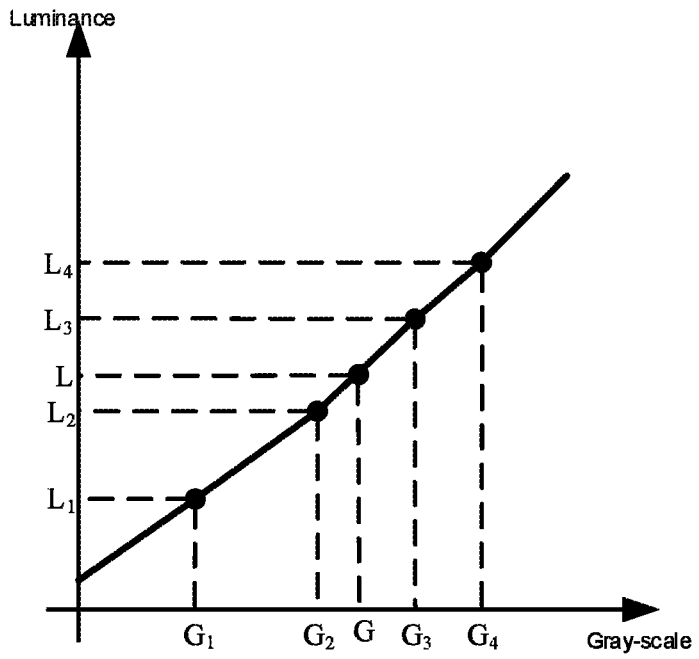
FIG. 6 is a schematic diagram of an actual luminance curve generated in a luminance compensation method, according to some embodiments of the present disclosure.

In some possible implementation manners, in step 124, the following process is used to fit the actual luminance curve: a line segment between every two adjacent points is obtained by using a linear function, and the actual luminance curve is generated based on all the obtained line segments. For example, as shown in FIG. 6, if four points of ($G_1$, $L_1$), ($G_2$, $L_2$), ($G_3$, $L_3$), and ($G_4$, $L_4$) are obtained, then a line segment that fits ($G_1$, $L_1$) and ($G_2$, $L_2$) can be obtained by using a linear function, a line segment that fits ($G_2$, $L_2$) and ($G_3$, $L_3$) can be obtained by using a linear function, and a line segment that fits ($G_3$, $L_3$) and ($G_4$, $L_4$) can be obtained by using a linear function. If the three line segments are connected, a middle portion of the actual luminance curve may be obtained.

Remaining portions of the actual luminance curve (i.e., portions proximate to two ends of the actual luminance curve, for example, a portion of the actual luminance curve corresponding to gray-scale values less than $G_1$, and a portion of the actual luminance curve corresponding to gray-scale values greater than $G_4$) may be obtained by an extrapolation method. For example, a function of the portion of the actual luminance curve corresponding to gray-scale values less than $G_1$ is a linear function determined according to ($G_1$, $L_1$) and ($G_2$, $L_2$), and a function of the portion of the actual luminance curve corresponding gray-scale values greater than $G_4$ is a linear function determined according to ($G_3$, $L_3$) and ($G_4$, $L_4$).

By performing step 121 to step 124, an actual luminance curve may be generated in the initial period of operation of the light-emitting device in the sub-pixel. The actual luminance curve generated in this period is an actual luminance curve of the light-emitting device in the sub-pixel under a current aging situation.

As a use time of the light-emitting device in the sub-pixel increases, the light-emitting device ages constantly, and the actual luminance value of the sub-pixel at a same gray-scale value gradually decreases. As a result, a degree of aging of the light-emitting device reflected by the actual luminance curve generated in step 121 to step 124 will gradually deviate from a degree of aging reflected by the actual luminance curve generated in the initial period. Therefore, the generated actual luminance curve needs to be constantly updated according to a real-time actual luminance value of the sub-pixel, so that a degree of aging of the light-emitting device reflected by the updated actual luminance curve may be as close as possible to or as consistent as possible with an actual degree of aging of the light-emitting device.

In some possible implementation manners, as shown in FIG. 2, "II—Curve update period" includes the following step 125 and step 126.

In step 125, after the actual luminance curve is generated, it is determined whether a gray-scale value converted from an actual luminance value detected in real time is one marked gray-scale value of the at least two marked gray-scale values; if the gray-scale value converted from the actual luminance value detected in real time is one marked gray-scale value of the at least two marked gray-scale values, an actual luminance value corresponding to the marked gray-scale value on the actual luminance curve is updated to the actual luminance value detected at the current moment, and step 126 is performed; and if the gray-scale value converted from the actual luminance value detected in real time is not one marked gray-scale value of the at least two marked gray-scale values, the method returns to step 122.

In this step, if the degree of aging of the light-emitting device in the sub-pixel has increased relative to a degree of aging of the light-emitting device when a previous actual luminance curve was generated, the actual luminance value corresponding to the marked gray-scale value on the actual luminance curve will change. When the actual luminance value corresponding to the marked gray-scale value is detected, the actual luminance value corresponding to the marked gray-scale value on the actual luminance curve will be updated to the actual luminance value detected at the current moment. That is, a point corresponding to the marked gray-scale value on the actual luminance curve is updated.

For example, if the actual luminance value detected at the current moment is $L_2'$, which corresponds to a marked gray-scale value of $G_2$, then a previous actual luminance value $L_2$ corresponding to the marked gray-scale value $G_2$ is updated to $L_2'$. That is, the point ($G_2$, $L_2$) on the actual luminance curve is updated to a point ($G_2$, $L_2'$).

In step 126, a curve refitting is performed according to the marked gray-scale value and the corresponding updated actual luminance value, and other marked gray-scale value(s) and respective corresponding actual luminance value(s), so as to obtain an updated actual luminance curve; and then the method returns to step 122.

In this step, points based on which the actual luminance curve is fitted are continuously updated according to the actual luminance values detected in real time, so as to achieve update of the actual luminance curve. In this way, the updated actual luminance curve may always reflect a latest degree of aging of the light-emitting device in the sub-pixel, which is conducive to improving the accuracy and effectiveness of luminance compensation.

For example, if it is assumed that the point ($G_2$, $L_2$) is updated to the point ($G_2$, $L_2'$), then a curve refitting is performed according to the points ($G_1$, $L_1$), ($G_2$, $L_2'$), ($G_3$, $L_3$), and ($G_4$, $L_4$), thus achieving the update of the actual luminance curve. In some examples, in this step, the following process is adopted in fitting the actual luminance curve: using a linear function to fit a line segment between every two adjacent points, and generating the actual luminance curve based on all the obtained line segments. A fitting process using a linear function herein is similar to a fitting process using a linear function in step 124, and details are not described herein again.

In some other possible implementation manners, as shown in FIG. 5, "II—Curve update period" includes the following step 125A to step 127A.

In step 125A, after the actual luminance curve is generated, it is determined whether a gray-scale value converted from an actual luminance value detected in real time is one marked gray-scale value of the at least two marked gray-scale values; if the gray-scale value converted from the actual luminance value detected in real time is one marked gray-scale value of the at least two marked gray-scale values, step 126A is performed; and if the gray-scale value converted from the actual luminance value detected in real time is not one marked gray-scale value of the at least two marked gray-scale values, the method returns to step 122.

In step 126A, it is determined whether the actual luminance value detected at the current moment is equal to an actual luminance value corresponding to the marked gray-scale value on the actual luminance curve; if the actual luminance value detected at the current moment is not equal to the actual luminance value corresponding to the marked gray-scale value on the actual luminance curve, the actual luminance value corresponding to the marked gray-scale value on the actual luminance curve is updated to the actual luminance value detected at the current moment, and step 127A is performed; and if the actual luminance value detected at the current moment is equal to the actual luminance value corresponding to the marked gray-scale value on the actual luminance curve, the method returns to step 122.

By performing step 125A and step 126A, it may be possible to update the actual luminance value corresponding to the marked gray-scale value to the actual luminance value detected at the current moment in a case where the actual luminance value corresponding to the marked gray-scale value has changed. That is, the actual luminance curve may be updated. In a case where the actual luminance value corresponding to the marked gray-scale value has not changed (that is, the light-emitting device in the sub-pixel is not aged or is only slightly aged), the actual luminance curve will not be updated. In this way, it may be possible to avoid a situation that the updated actual luminance curve is the same as the actual luminance curve before the update, which is conducive to improving a processing speed of a processor in the driver IC of the display device.

In step 127A, a curve refitting is performed according to the marked gray-scale value and the corresponding updated actual luminance value, and other marked gray-scale value(s) and respective corresponding actual luminance value(s), so as to obtain an updated actual luminance curve; and then the method returns to step 122.

In this step, points based on which the actual luminance curve is fitted are continuously updated according to the actual luminance values detected in real time, so as to achieve the update of the actual luminance curve. In this way, the updated actual luminance curve may always reflect the latest degree of aging of the light-emitting device in the sub-pixel, which is conducive to improving the accuracy and effectiveness of luminance compensation.

The above is an introduction to the curve generation and update process in the luminance compensation method. The compensation process in the luminance compensation method is described below.

Figure 7:
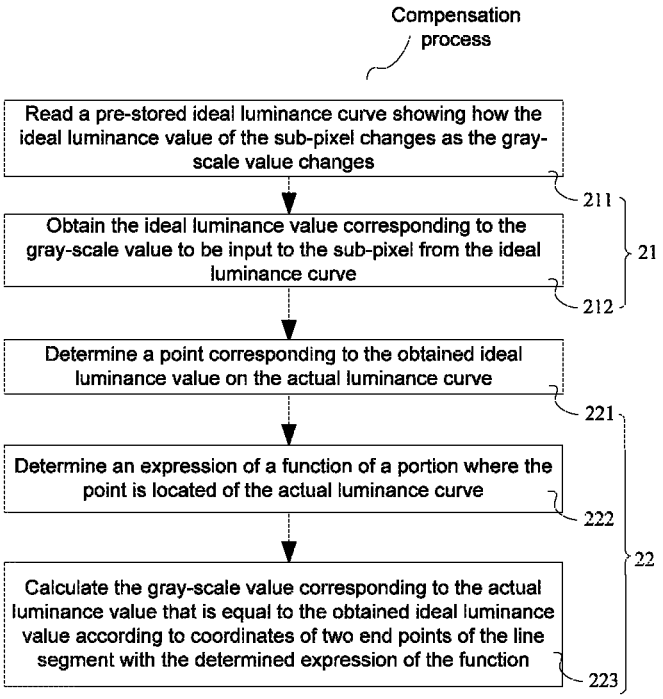
FIG. 7 is a schematic flow diagram of a compensation process in a luminance compensation method, according to some embodiments of the present disclosure.

As shown in FIGS. 1 and 7, the compensation process includes the following step 21 and step 22 for each sub-pixel in the display device.

In step 21, an ideal luminance value corresponding to a gray-scale value to be input to the sub-pixel is obtained. The ideal luminance value is a luminance value of the sub-pixel after the gray-scale is input to the sub-pixel in a case where a light-emitting device in the sub-pixel is not aged.

In some other embodiments, referring to FIG. 7, the above step 21 includes the following step 211 and step 212.

In step 211, a pre-stored ideal luminance curve showing how the ideal luminance value of the sub-pixel changes as the gray-scale value changes is read.

In this step, the pre-stored ideal luminance curve may be stored in a memory of the display device in advance before the display device leaves the factory.

In some examples, the luminance compensation method further includes a step of generating the ideal luminance curve, and the step includes the following process.

Under a condition where the light-emitting device in the sub-pixel is not aged (for example, before the display device leaves the factory, since the display device has not been put into actual use, it may be considered that the light-emitting device of the sub-pixel therein is not aged), ideal luminance values of the sub-pixel at different gray-scales are detected to obtain at least two sets of data indicating a correspondence between gray-scale values and ideal luminance values.

A curve fitting is performed according to the at least two sets of data indicating the correspondence between the gray-scale values and ideal luminance values, so as to obtain the ideal luminance curve.

A linear function may be used in the fitting. The number of sets of data indicating the correspondence between the gray-scale values and ideal luminance values may be determined according to actual needs. The more sets of data there are, the more accurate the finally obtained ideal luminance curve will be.

In step 212, the ideal luminance value corresponding to the gray-scale value to be input to the sub-pixel is obtained from the ideal luminance curve.

In this step, the obtained ideal luminance value is a luminance value that the sub-pixel should achieve at a gray-scale value to be input at the current moment in the case where the light-emitting device in the sub-pixel is not aged.

After step 21, the compensation process further includes step 22. In step 22, a gray-scale value corresponding to an actual luminance value that is equal to the obtained ideal luminance value is calculated according to the actual luminance curve of the sub-pixel, and the gray-scale value is used as a gray-scale value that will actually be input to the sub-pixel.

By performing step 22, it may be possible to ensure that, at the gray-scale value actually input to the sub-pixel, the luminance of the sub-pixel reaches the desired ideal luminance value in the current frame, thereby achieving real-time compensation of the luminance of the sub-pixel and improving a uniformity of display luminance.

Referring to FIG. 7, in some embodiments, if the actual luminance curve is obtained by using a linear function, then step 22 may include the following step 221 to step 223.

In step 221, a point corresponding to the obtained ideal luminance value on the actual luminance curve is determined.

Referring to FIG. 6, in this step, if it is assumed that the fitting is performed based on four points of $(G_1, L_1)$, $(G_2, L_2)$, $(G_3, L_3)$, and $(G_4, L_4)$, and the obtained ideal luminance value L is greater than or equal to $L_2$ and less than or equal to $L_3$ ($L_2 \leq L \leq L_3$), then it may be determined that a point corresponding to the ideal luminance value L on the actual luminance curve is located on a line segment between the points $(G_2, L_2)$ and $(G_3, L_3)$.

In step 222, an expression of a function of a portion where the point is located of the actual luminance curve is determined.

Referring to FIG. 6, in this step, if it is assumed that the gray-scale value corresponding to the actual luminance value that is equal to the obtained ideal luminance value L is G, then the expression of the function of the portion where the point is located of the actual luminance curve is: L=kG+b, where $$k = \frac{L_3 - L_2}{G_3 - G_2}, \text{ and } b = L_2 - \frac{L_3 - L_2}{G_3 - G_2} \bullet G_2.$$

Therefore, it may be obtained that:

$$L = \frac{L_3 - L_2}{G_3 - G_2} \bullet G + L_2 - \frac{L_3 - L_2}{G_3 - G_2} \bullet G_2.$$

In step 223, the gray-scale value corresponding to the actual luminance value that is equal to the obtained ideal luminance value is calculated according to the determined expression of the function.

In this step, L is known. If L is substituted into the expression of the function of the line segment, the following formula (1) is obtained:

$$G = G_2 + \frac{(L - L_2)(G_3 - G_2)}{L_3 - L_2}. \quad (1)$$

From the above formula (1), if it is assumed that the point corresponding to the ideal luminance value L on the actual luminance curve is located on a line segment between points ($G_n$, $L_n$) and ($G_{n+1}$, $L_{n+1}$), and n is greater than or equal to 1 ($n \geq 1$), then it may be possible to calculate the gray-scale value corresponding to the actual luminance value that is equal to the obtained ideal luminance value G using the following formula (2):

$$G = G_n + \frac{(L - L_n)(G_{n+1} - G_n)}{L_{n+1} - L_n}. \quad (2)$$

It will be noted that, in a case where the point corresponding to the ideal luminance value L on the actual luminance curve is located at a portion proximate to one of two ends of the actual luminance curve (for example, in FIG. 6, a portion of the actual luminance curve corresponding to ideal luminance values less than $L_1$, and a portion of the actual luminance curve corresponding to ideal luminance values greater than $L_4$), the expression of the function of the portion where the point is located of the actual luminance curve may be determined according to two points adjacent to the point. For example, referring to FIG. 6, in a case where L is less than $L_1$, the two points adjacent to the point corresponding to L on the actual luminance curve are the points ($G_1$, $L_1$) and ($G_2$, $L_2$). In this case, the expression of the function of the portion where the point corresponding to L on the actual luminance curve is located on the actual luminance curve is a linear function determined according to the points ($G_1$, $L_1$) and ($G_2$, $L_2$). If L is substituted into the linear function, it may be possible to obtain the gray-scale value G corresponding to the actual luminance value that is equal to the obtained ideal luminance value. In a case where L is greater than $L_4$, the two points adjacent to the point corresponding to L on the actual luminance curve are the points ($G_3$, $L_3$) and ($G_4$, $L_4$). In this case, the expression of the function of the portion where the point corresponding to L on the actual luminance curve is located on the actual luminance curve is a linear function determined according to the points ($G_3$, $L_3$) and ($G_4$, $L_4$). If L is substituted into the linear function, it may be possible to obtain the gray-scale value G corresponding to the actual luminance value that is equal to the obtained ideal luminance value.

In the luminance compensation method provided in some embodiments of the present disclosure, the actual luminance values of the sub-pixel are detected in real time, and the actual luminance curve showing how the actual luminance value of the sub-pixel changes as the gray-scale value changes is generated and updated according to the actual luminance values detected in real time. In this way, the actual luminance curve may be able to reflect an actual luminance of the sub-pixel when the sub-pixel is driven by gray-scale data at the current moment, so as to indicate the degree of aging of the light-emitting device in the sub-pixel. During a compensation process of the sub-pixel, the ideal luminance value corresponding to the gray-scale value to be input to the sub-pixel is obtained, and then the gray-scale value corresponding to the actual luminance value that is equal to the obtained ideal luminance value is calculated. Therefore, by inputting the calculated gray-scale value to the sub-pixel, it may be possible to obtain the ideal luminance value, thereby achieving real-time and effective compensation of the luminance of the sub-pixel, and improving a luminance uniformity of the display device during display.

The method described in some embodiments of the present disclosure may be implemented by means of executing software instructions. The software instructions may be composed of relevant software modules, which can be stored in a random access memory (RAM), a flash memory, a read only memory (ROM), an erasable programmable read only memory (EPROM), an electrically erasable programmable read only memory (EEPROM), a register, a hard disk, a removable hard disk, a compact disk read only memory (CD-ROM), or any other form of storage medium known in the art.

Therefore, some embodiments of the present disclosure provide a non-transitory computer-readable storage medium. The non-transitory computer-readable storage medium stores computer instructions that are configured to perform the display method described above.

In some embodiments of the present disclosure, a computer program product is provided. The computer program product includes instructions that, when run on a computer, cause the computer to execute one or more steps of the luminance compensation method as described in some embodiments of the present disclosure. In this case, real-time compensation of the luminance of the sub-pixel in the display device may be achieved.

A person skilled in the art will appreciate that in one or more of the examples described above, the functions described in the present disclosure may be implemented by using a hardware, a software, a firmware, or any combination thereof. When implemented in software, the functions may be stored in a computer-readable medium or transmitted as one or more instructions or codes in a computer-readable medium. The computer-readable medium includes a computer storage medium and a communication medium, and the communication medium includes any medium convenient for transmitting computer programs from one location to another. The storage medium may be any available medium that may be accessed by a general-purpose or special-purpose computer.

Figure 8:
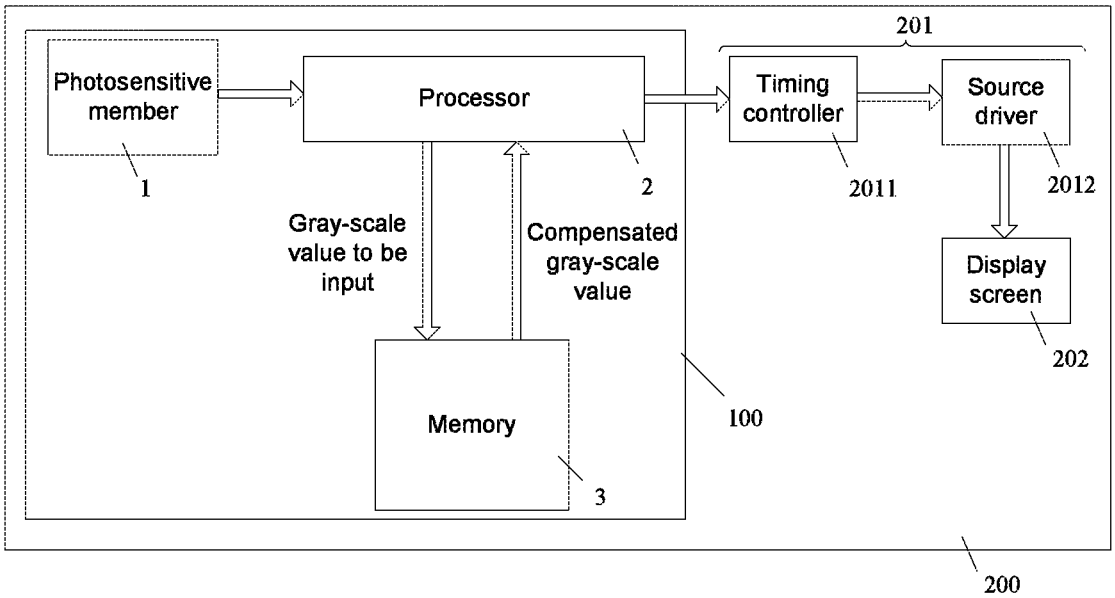
FIG. 8 is a schematic structural diagram of a luminance compensation apparatus, according to some embodiments of the present disclosure.

Some embodiments of the present disclosure provide a luminance compensation apparatus. As shown in FIG. 8, the luminance compensation apparatus 100 includes a plurality of photosensitive members 1, a processor 2, and a memory 3.

Figure 9:
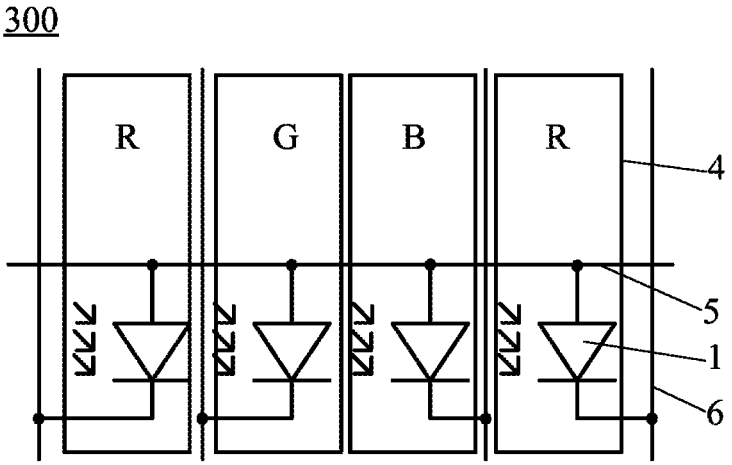
FIG. 9 is a schematic structural diagram of a display substrate, according to some embodiments of the present disclosure.

Referring to FIG. 9, the plurality of photosensitive members 1 and a plurality of sub-pixels 4 of the display device are provided to be in one-to-one correspondence. In some embodiments, each sub-pixel 4 is provided with at least one photosensitive member 1, and the photosensitive member 1 is configured to sense luminance of a corresponding sub-pixel 4 in real time. For example, the photosensitive member 1 may be an optical sensor, such as a photosensitive diode.

The processor 2 can receive luminance data output from each photosensitive member 1, determine a real-time actual luminance value of a corresponding sub-pixel, generate an actual luminance curve showing how the actual luminance value of each sub-pixel changes as a gray-scale value changes, and update the actual luminance curve. It will be noted that, as for a process in which the processor 2 generates and updates the actual luminance curve, reference may be made to the description of step 12 in the luminance compensation method described above, and details are not described herein again.

As shown in FIG. 8, the memory 3 is connected to the processor 2. The memory 3 is configured to store a latest actual luminance curve of each sub-pixel 4 and an ideal luminance curve showing how an ideal luminance value of each sub-pixel 4 changes as the gray-scale value changes. It will be noted that, the ideal luminance value is a luminance value of a corresponding sub-pixel in the case where the light-emitting device in the sub-pixel is not aged. The ideal luminance curve may be obtained through detection before the display device leaves the factory (that is, when the light-emitting device is not aged) and stored in the display device in advance. It will be noted that, as for a process of generating the ideal luminance curve, reference may be made to the description of step 211 in the luminance compensation method described above, and details are not described herein again.

The processor 2 is further configured to: read the actual luminance curve and the ideal luminance curve from the memory 3; obtain an ideal luminance value corresponding to a gray-scale value to be input to each sub-pixel from the ideal luminance curve of the sub-pixel 4; and calculate a gray-scale value corresponding to an actual luminance value that is equal to the obtained ideal luminance value according to the actual luminance curve of the sub-pixel, the gray-scale value being used as a gray-scale value that the sub-pixel 4 should actually input in the current frame. As for a specific calculation process, reference may be made to the description of step 21 and step 22 in the luminance compensation method described above, and details are not described herein again.

It will be noted that, as for a way of obtaining the gray-scale value to be input to the sub-pixel 4, in some embodiments, the processor 2 is connected to a controller 201 for outputting gray-scale data in the display device 200, so that the processor 2 may be able to obtain the gray-scale value to be input to the sub-pixel 4 from the controller 201. In some examples, as shown in FIG. 8, the controller 201 includes a timing controller 2011, and the processor 2 may be able to, obtain the gray-scale value to be input to the sub-pixel 4 from the timing controller 2011 in the controller 201.

On this basis, after the processor 2 calculates the gray-scale value that the sub-pixel 4 should actually input in the current frame (that is, the compensated gray-scale value), the processor 2 will transmit the compensated gray-scale value to the controller 201, and then the controller 201 will input the compensated gray-scale value to a display screen 202 of the display device. In some examples, as shown in FIG. 8, the controller 201 includes a timing controller 2011 and a source driver 2012. The processor 2 may output the compensated gray-scale value to the timing controller 2011 in the controller 201, and then the timing controller 2011 processes and converts the compensated gray-scale value. Then, the processed and converted compensated gray-scale value will be output to the source driver 2012 by the timing controller 2011, and finally be input to the display screen 202 of the display device by the source driver 2012.

In some embodiments, the controller 201 is integrated into the driver IC of the display device, and the processor 2 and the memory 3 are also integrated into the driver IC. In some other embodiments, the processor 2 and the controller 201 are integrated into a one-piece structure.

In some embodiments, the processor 2 is further configured to: obtain luminance data sensed by a photosensitive member corresponding to each sub-pixel at least twice in a time of a frame so as to obtain at least two sets of luminance data, select one set of luminance data from the at least two sets of luminance data, and determine an actual luminance value of the corresponding sub-pixel in the current frame according to the selected one set of luminance data. As for a specific method for the processor 2 to determine the actual luminance value of the corresponding sub-pixel in the current frame, reference may be made to the description of step 11 in the luminance compensation method described above, and details are not described herein again.

In some embodiments of the present disclosure, a display device is provided. Referring to FIG. 8, the display device 200 includes a controller 201, a display screen 202, and a luminance compensation apparatus 100 as described in some embodiments of the present disclosure. With this design, real-time compensation of the luminance of the sub-pixels in the display device may be achieved, and a display uniformity of the display screen 202 may thus be improved.

In some examples, the display device is an OLED display device, for example, an electronic paper, a mobile phone, a tablet computer, a television, a monitor, a laptop computer, a digital photo frame, a navigator, or any other product or component having a display function. In some examples, the display device is a liquid crystal panel.

In some embodiments of the present disclosure, a display substrate is provided. The display substrate may be applied to a display screen of the display device, so that the display device can display images. As shown in FIG. 9, the display substrate 300 includes a plurality of sub-pixels 4, a plurality of photosensitive members 1, a plurality of driving lines 5, and a plurality of sensing lines 6.

The plurality of photosensitive members 1 are provided corresponding to the plurality of sub-pixels 4, respectively. In some examples, each sub-pixel 4 is provided with at least one photosensitive member 1, and each photosensitive member 1 is able to sense luminance of a corresponding sub-pixel 4 in real time.

Each driving line 5 is electrically connected to an input terminal of at least one photosensitive member 1, and the driving line 5 is configured to drive the corresponding photosensitive member 1 to sense luminance.

Each sensing line 6 is electrically connected to an output terminal of at least one photosensitive member 1, and the sensing line 6 is configured to collect luminance data sensed by the corresponding photosensitive member 1.

With this structural design, it may be possible to obtain real-time luminance data sensed by a single photosensitive member 1 in each sub-pixel 4 through each sensing line 6, and then obtain the actual luminance value of each sub-pixel according to the luminance data. The obtained actual luminance value may be used as a calculation basis for compensating the luminance of the corresponding sub-pixel 4 in real time.

In some embodiments, each photosensitive member 1 is a photoelectric sensor (such as a photosensitive diode), and each photoelectric sensor includes an anode and a cathode. The driving line 5 is connected to the anode of a corresponding photoelectric sensor, and the sensing line 6 is connected to the cathode of a corresponding photoelectric sensor.

With continued reference to FIG. 9, in some embodiments, as for a pixel arrangement structure with a matrix arrangement in multiple rows and multiple columns, photosensitive members 1 corresponding to each row of sub-pixels are connected to a same driving line 5, and photosensitive members 1 corresponding to each column of sub-pixels are connected to a same sensing line 6. In this way, by scanning the plurality of driving lines 5 one by one to drive the photosensitive members 1 of multiple rows of sub-pixels row by row, and obtaining luminance data from each sensing line 6, it may be possible to obtain the luminance data output by at least one photosensitive member of each sub-pixel.

The foregoing descriptions are merely specific implementation manners of the present disclosure, but the protection scope of the present disclosure is not limited thereto, and the protection scope of the present disclosure shall be subject to the protection scope of the claims.

What is claimed is:

1. A luminance compensation method configured to compensate luminance of a plurality of sub-pixels included in a display device, the luminance compensation method comprising a curve generation and update process and a compensation process for each sub-pixel to be compensated, wherein the curve generation and update process includes:

detecting an actual luminance value of the sub-pixel to be compensated in real time; wherein detecting an actual luminance value of the sub-pixel to be compensated in real time, includes:

obtaining luminance data sensed by a photosensitive member corresponding to the sub-pixel to be compensated at least twice in a time of a frame, so as to obtain at least two sets of luminance data;

determining a sensing time corresponding to each set of luminance data:

estimating an estimated luminance value of the sub-pixel to be compensated at a current moment in a current frame according to a gray-scale value to be input to the sub-pixel to be compensated at the current moment;

estimating an estimated sensing time required for the photosensitive member corresponding to the sub-pixel to be compensated to obtain luminance data corresponding to the estimated luminance value;

selecting a set of luminance data with a sensing time closest to the estimated sensing time from the at least two sets of luminance data, and determining an actual luminance value of the sub-pixel to be compensated in the current frame according to the set of luminance data;

generating an actual luminance curve showing how the actual luminance value of the sub-pixel to be compensated changes as a gray-scale value changes according to actual luminance values detected in real time; and updating the actual luminance curve;

the compensation process includes:

obtaining an ideal luminance value corresponding to a gray-scale value to be input to the sub-pixel to be compensated, the ideal luminance value being a luminance value of the sub-pixel to be compensated after the gray-scale value is input to the sub-pixel to be compensated in a case where a light-emitting device in the sub-pixel to be compensated is not aged; and calculating a gray-scale value corresponding to an actual luminance value that is equal to the obtained ideal luminance value according to the actual luminance curve of the sub-pixel to be compensated, the gray-scale value being used as a gray-scale value that will actually be input to the sub-pixel to be compensated.

2. The luminance compensation method according to claim 1, wherein updating the actual luminance curve, includes:

updating the actual luminance curve according to at least one actual luminance value detected in real time.

3. The luminance compensation method according to claim 2, wherein generating an actual luminance curve showing how the actual luminance value of the sub-pixel to be compensated changes as a gray-scale value changes according to actual luminance values detected in real time, includes:

setting at least two marked gray-scale values;

converting an actual luminance value detected in real time to a corresponding gray-scale value;

determining whether the corresponding gray-scale value converted from the actual luminance value detected in real time is one marked gray-scale value of the at least two marked gray-scale values:

if the corresponding gray-scale value converted from the actual luminance value detected in real time is one marked gray-scale value of the at least two marked gray-scale values, recording the actual luminance value corresponding to the marked gray-scale value and proceeding to a next step; and if the corresponding gray-scale value converted from the actual luminance value detected in real time is not one marked gray-scale value of the at least two marked gray-scale values, returning to the step of converting an actual luminance value detected in real time to a corresponding gray-scale value; and determining whether actual luminance values have been recorded for the at least two marked gray-scale values:

if actual luminance values have been recorded for the at least two marked gray-scale values, performing a curve fitting according to the at least two marked gray-scale values and respective corresponding actual luminance values, so as to generate the actual luminance curve; and if actual luminance values have not been recorded for the at least two marked gray-scale values, returning to the step of converting an actual luminance value detected in real time to a corresponding gray-scale value.

4. The luminance compensation method according to claim 3, wherein updating the actual luminance curve according to the actual luminance values detected in real time, includes:

determining whether a gray-scale value converted from an actual luminance value detected at a current moment is one marked gray-scale value of the at least two marked gray-scale values:

if the gray-scale value converted from the actual luminance value detected at a current moment is one marked gray-scale value of the at least two marked gray-scale values, updating an actual luminance value corresponding to the marked gray-scale value on the actual luminance curve to an actual luminance value detected at the current moment and proceeding to a next step; and if the gray-scale value converted from the actual luminance value detected at a current moment is not one marked gray-scale value of the at least two marked gray-scale values, returning to the step of converting an actual luminance value detected in real time to a corresponding gray-scale value;

performing a curve refitting according to the marked gray-scale value and a corresponding updated actual luminance value, and at least one other marked gray-scale value and its corresponding actual luminance value, so as to obtain an updated actual luminance curve; and returning to the step of converting an actual luminance value detected in real time to a corresponding gray-scale value.

5. The luminance compensation method according to claim 3, wherein updating the actual luminance curve according to the actual luminance values detected in real time, includes:

determining whether a gray-scale value converted from an actual luminance value detected at a current moment is one marked gray-scale value of the at least two marked gray-scale values:

if the gray-scale value converted from the actual luminance value detected at a current moment is one marked gray-scale value of the at least two marked gray-scale values, determining whether the actual luminance value detected at the current moment is equal to an actual luminance value corresponding to the marked gray-scale value on the actual luminance curve:

if the actual luminance value detected at the current moment is not equal to the actual luminance value corresponding to the marked gray-scale value on the actual luminance curve, updating the actual luminance value corresponding to the marked gray-scale value on the actual luminance curve to the actual luminance value detected at the current moment and proceeding to a next step;

if the actual luminance value detected at the current moment is equal to the actual luminance value corresponding to the marked gray-scale value on the actual luminance curve, returning to the step of converting an actual luminance value detected in real time to a corresponding gray-scale value; and if the gray-scale value converted from the actual luminance value detected at the current moment is not one marked gray-scale value of the at least two marked gray-scale values, returning to the step of converting an actual luminance value detected in real time to a corresponding gray-scale value;

performing a curve refitting according to the marked gray-scale value and a corresponding updated actual luminance value, and at least one other marked gray-scale value and its corresponding actual luminance value, so as to obtain an updated actual luminance curve; and returning to the step of converting an actual luminance value detected in real time to a corresponding gray-scale value.

6. The luminance compensation method according to claim 3, wherein performing a curve fitting includes:

using the at least two marked gray-scale values and respective corresponding actual luminance values as multiple points on an actual luminance curve to be fitted;

using a linear function to perform a fitting to obtain a line segment between every two adjacent points; and generating the actual luminance curve according to all obtained line segments.

7. The luminance compensation method according to claim 6, wherein calculating a gray-scale value corresponding to an actual luminance value that is equal to the obtained ideal luminance value according to the actual luminance curve of the sub-pixel to be compensated, includes:

determining a point corresponding to the obtained ideal luminance value on the actual luminance curve;

determining an expression of a function of a portion where the point is located of the actual luminance curve; and calculating a gray-scale value corresponding to an actual luminance value that is equal to the ideal luminance value according to the determined expression of the function.

8. The luminance compensation method according to claim 3, wherein a number of the marked gray-scale values is greater than or equal to 2, and less than or equal to a maximum number of gray-scale values displayable by the sub-pixel to be compensated.

9. The luminance compensation method according to claim 1, wherein the luminance data is sensed 3 to 6 times in the time of a frame, so as to obtain 3 to 6 sets of luminance data.

10. The luminance compensation method according to claim 1, wherein estimating an estimated luminance value of the sub-pixel to be compensated at a current moment in a current frame according to a gray-scale value to be input to the sub-pixel to be compensated at the current moment includes:

determining whether an actual luminance curve has been generated for the sub-pixel to be compensated at the current moment;

if an actual luminance curve has been generated for the sub-pixel to be compensated at the current moment, obtaining an actual luminance value corresponding to the gray-scale value to be input to the sub-pixel to be compensated at the current moment according to the actual luminance curve at the current moment, the obtained actual luminance value being used as the estimated luminance value; and if an actual luminance curve has not been generated for the sub-pixel to be compensated at the current moment, obtaining an ideal luminance value corresponding to the gray-scale value to be input to the sub-pixel to be compensated at the current moment according to an ideal luminance curve, the obtained ideal luminance value being used as the estimated luminance value.

11. The luminance compensation method according to claim 1, wherein obtaining an ideal luminance value corresponding to a gray-scale value to be input to the sub-pixel to be compensated, includes:

reading a pre-stored ideal luminance curve showing how the ideal luminance value of the sub-pixel to be compensated changes as the gray-scale value changes, and obtaining the ideal luminance value corresponding to the gray-scale value to be input to the sub-pixel to be compensated.

12. The luminance compensation method according to claim 11, further comprising:

generating the ideal luminance curve, which includes:

under a condition where the light-emitting device in the sub-pixel to be compensated is not aged, detecting ideal luminance values of the sub-pixel to be compensated at different gray-scales to obtain at least two sets of data indicating a correspondence between gray-scale values and ideal luminance values; and performing a curve fitting according to the at least two sets of data indicating the correspondence between the gray-scale values and the ideal luminance values, so as to obtain the ideal luminance curve.

13. A non-transitory computer-readable storage medium storing computer instructions that are configured to perform one or more steps of the luminance compensation method according to claim 1.

14. A luminance compensation apparatus, comprising:

a plurality of photosensitive members that are in one-to-one correspondence with a plurality of sub-pixels of a display device, each photosensitive member being configured to sense luminance of a corresponding sub-pixel in real time and output luminance data;

a processor connected to the plurality of photosensitive members, the processor being configured to receive luminance data output from each photosensitive member, determine an actual luminance value of the corresponding sub-pixel in real time, generate an actual luminance curve showing how the actual luminance value of each sub-pixel changes as a gray-scale value changes, and update the actual luminance curve; and a memory connected to the processor, the memory being configured to store a latest actual luminance curve of each sub-pixel and an ideal luminance curve of each sub-pixel showing how an ideal luminance value of each sub-pixel changes as the gray-scale value changes, the ideal luminance value being a luminance value of a corresponding sub-pixel in a case where a light-emitting device in the sub-pixel is not aged, wherein the processor is further configured to: obtain an ideal luminance value corresponding to a gray-scale value to be input to the corresponding sub-pixel according to the ideal luminance curve of each sub-pixel, and calculate a gray-scale value corresponding to an actual luminance value that is equal to the obtained ideal luminance value according to the actual luminance curve of the corresponding sub-pixel, wherein the gray-scale value is used as a gray-scale value that will actually be input to the corresponding sub-pixel, and the processor is further configured to: obtain luminance data sensed by a photosensitive member corresponding to each sub-pixel at least twice in a time of a frame so as to obtain at least two sets of luminance data, select one set of luminance data from the at least two sets of luminance data, and determine an actual luminance value of the corresponding sub-pixel in a current frame according to the selected one set of luminance data.

15. A display device, comprising the luminance compensation apparatus according to claim 14.

16. A display substrate which is configured to be used on the display device according to claim 15, comprising:

a plurality of sub-pixels;

a plurality of photosensitive members that are in one-to-one correspondence with the plurality of sub-pixels, each photosensitive member being configured to sense luminance of a corresponding sub-pixel in real time;

a plurality of driving lines, each driving line being connected to an input terminal of at least one photosensitive member of the plurality of photosensitive members, and each driving line being configured to drive corresponding at least one photosensitive member to sense luminance; and a plurality of sensing lines, each sensing line being connected to an output terminal of at least one photosensitive member of the plurality of photosensitive members, and each sensing line being configured to collect luminance data sensed by corresponding at least one photosensitive member.

* * * * *